United States Patent [19]

Wan

[11] Patent Number: 4,975,335

[45] Date of Patent: Dec. 4, 1990

[54] FE-MN-AL-C BASED ALLOY ARTICLES AND PARTS AND THEIR TREATMENTS

[75] Inventor: Chi-Meen Wan, Hacienda Heights, Calif.

[73] Assignee: Fancy Steel Corporation, Pittsburgh, Pa.

[21] Appl. No.: 341,073

[22] Filed: Apr. 20, 1989

Related U.S. Application Data

[63] Continuation-in-part of Ser. No. 218,695, Jul. 8, 1988, Pat. No. 4,875,933.

[51] Int. Cl.[5] ..... C23C 22/00; C23C 8/26; C23C 33/04; C23F 4/04

[52] U.S. Cl. ..... 428/610; 148/4; 148/13; 148/901; 148/329; 148/318; 219/121.66; 156/664; 204/140; 75/10.42

[58] Field of Search ..... 420/72, 79, 74, 56, 420/57, 58; 148/329, 901, 902, 903, 318, 16.6, 4, 13, 14; 428/610; 219/121.66, 121.65; 156/626, 624, 625, 664; 204/140, 129.1; 134/2; 75/10.41, 10.42, 10.48, 10.66

[56] References Cited

U.S. PATENT DOCUMENTS 4,157,923 6/1979 Yen et al. ..... 148/4

FOREIGN PATENT DOCUMENTS 234177 12/1959 Australia ..... 148/329

653569 12/1962 Canada ..... 420/72

54-160529 12/1979 Japan ..... 204/140

1145047 3/1985 U.S.S.R. ..... 148/318

*Primary Examiner*—Deborah Yee

[57] ABSTRACT

This application is a continuation-in-part of application Ser. No. 07/218695, filed Aug. 8, 1988. This invention describes a series of Fe-Mn-Al-C based corrosion resistance alloys. It also describes how to obtain such alloys which has comparable good corrosion resistance in many environments to conventional stainless steel as 304 and 430. The correlation of chemical compositions among the manganese, aluminum, carbon and other minor elements ae discussed. Therefore they are made to be practical and more definitive. According to more advanced understanding in overall of the Fe-Mn-Al-C based alloys that are included in this invention have to be surface treated and/or pickled, passivated by the methods included in this invention. After the surface treatments, the final products will have an obviously comparable depleted manganese and/or higher chromium on the alloy surface and will have better corrosion resistance than the conventional Fe-Mn-Al-C and Fe-Mn-Al-C-Cr based alloys.

In addition, the manufacture and fabrication processes for the present designed Fe-Mn-Al-C based alloys also include the meltings, mixings, ingot castings, hot workings, cold workings, heat treatments and surface treatments.

13 Claims, 3 Drawing Sheets

FE-MN-AL-C BASED ALLOY ARTICLES AND PARTS AND THEIR TREATMENTS

The present application is a continuation-in-part of U.S. application Ser. No. 218,695 filed July 8, 1988, now U.S. Pat. No. 4,875,933.

BACKGROUND OF INVENTION

Since 1890, Hadfield had developed the Fe-Mn-Al-C based alloy system which had been designed and patented by many people, for example, U.S. Pat. Nos. 422,403, 1,892,316, 3,111,405, 3,210,230, and Canada patent No. 655,824 and etc. In those years, this alloy system had always failed to be commercialized and industrialized. According to all of the former patents, no detailed and practical manufacture and fabrication processes of this alloy system had been invented before. Most important of all, no good corrosion resistant Fe-Mn-Al-C based alloy which is comparable to stainless 304, 430 had been developed in those past patents.

By the way, the melting process of the mass production of the Fe-Mn-Al-C based alloys is also a problem which was never solved before. Only the induction furnace melting process was used in these past patents and the production quantity was restricted by the small capacity of the induction furnace. It is also known that aluminum can not be melted in the arc furnace. Under such consideration, it is impossible to melt the Fe-Mn-Al-C based alloy in the arc furnace directly. A better way to melt the alloy is disclosed in this patent.

To obtain products with comparable good corrosion resistances such as S.S. 430,304 for the Fe-Mn-Al-C based alloys, it cannot depend on the chemical composition arrangements only. A series of detailed manufacture, fabrication processes and special surface treatments are included in this invention.

BRIEF DESCRIPTION OF THE INVENTION

Figure 1:
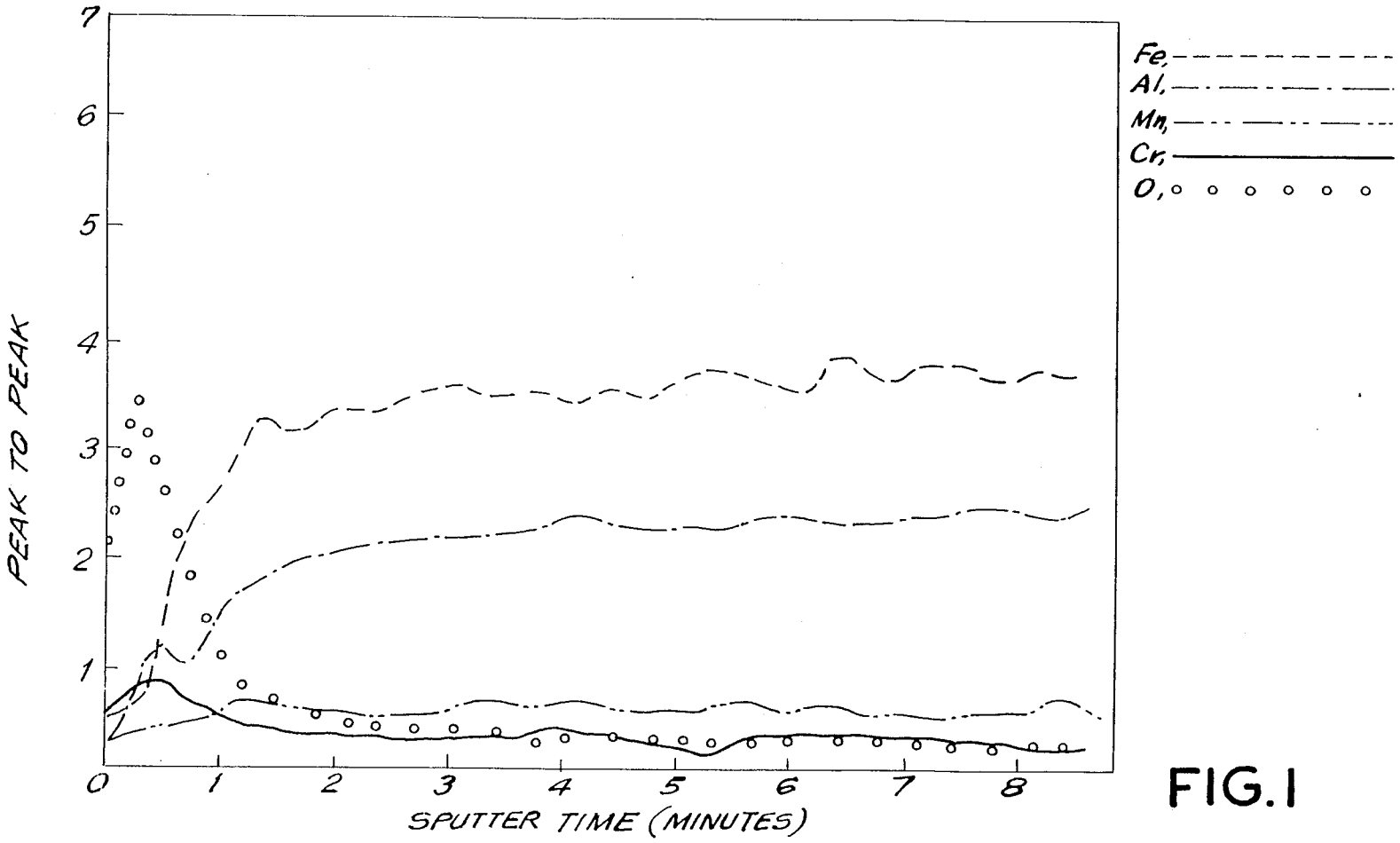
FIG. 1 depicts the surface concentration gradients before pickling treatment.

The present invention includes a series of Fe-Mn-Al-C based alloys which have to be specially surface treated such as surface heating, pickling and passivation, and etc. The Fe-Mn-Al-C based alloys included in the present invention are directly combined with the surface treatments.

The chemical composition of the surface treated corrosion resistant Fe-Mn-Al-C based alloys in this invention comprises principally 10 to 45 weight percent of manganese, 4 to 15 weight percent of aluminum, 0.01 to 1.4 weight percent of carbon. In addition, the alloy may also contain up to 12 weight percent of chromium, up to 4.0 weight percent of molybdenum, up to 4 weight percent of copper, up to 2.5 weight percent of silicon, up to 7.5 weight percent of nickel, and it also further may comprise one or more of the following elements: columbium, cobalt, titanium, scandium, yttrium, hafnium and the balanced iron.

The method of producing the said Fe-Mn-Al-C based alloy product which comprises the following processing:

1. Melting

The combination of the arc furnace, induction furnace, ladle furnace, and the like, with the bubbling using a non-oxidizing gas such as argon, nitrogen, mixture thereof, etc. and mixing and controlled atmosphere are used as a melting practice.

2. Surface treatments

The objects of the surface treatments on the products of the Fe-Mn-Al-C based alloy enable a clean surface of the products by removing the scale, rust, grease and forming a protective layer depleted in manganese or enhanced in chromium on the surface in order to increase the corrosion resistance. These surface treatments include the in particular pickling, electrolytic pickling or polishing, high-energy surface heating (e.g. laser heating process), etc. anodizing, color development process, etc. electrolytic cleaning (periodic reverse electrocleaning anodic electrocleaning and cathodic electrocleaning), emulsion cleaning, solvent cleaning, acid cleaning, abrasive blast cleaning, polishing, buffing, mass finishing, power brush cleaning and finishing, salt bath descaling, acid pickling, passivation, and rinse.

DETAIL OF INVENTION

This invention includes a series of well and precisely defined surface treated Fe-Mn-Al-C based alloys. These alloys have comparable good corrosion resistance after surface treatment in many environments (water, atmosphere, salt water and etc.) to conventional 304, 430 stainless steels. In addition, the alloys in this invention also have good workability, weldability, preferable strength and lower density than those of the conventional stainless steels.

Followed by the chemical composition arrangement of the alloy in this invention, detailed manufacture and fabrication processes of this alloy are included. Some special surface treatments such as surface pickling and passivation for these alloys are included and combined. Special surface heating (such as high frequency induction heating) within certain controlled low pressure atmosphere is also described. With the preferential dissolution or evaporation of manganese by pickling solution or by appropriate high temperature surface treatment, concentrations of corrosion resistant elements are increased on the surface layer of the alloys. It is believed a better understanding on such treatment can be obtained from the following detailed descriptions and examples.

The chemical compositions of the surface treated good corrosion resistance Fe-Mn-Al-C based alloy consists of 10 to 45 weight percent of manganese, 4.0 to 15.0 weight percents of aluminum, 0.01 to 1.4 weight percents of carbon. In addition, the alloy may also contain up to 12 weight percents of chromium, up to 4 weight percents of copper, up to 7.5 percents of nickel, up to 2.5 weight percents of silicon, up to 4.0 weight percents of molybdenum. Furthermore, they comprise one or more of the following elements: titanium (up to 3.5 wt %), tungsten (up to 3.5 wt %), vanadium (up to 3.5 wt %), cobalt (up to 3.5 wt %), boron (up to 2000 ppm), zirconium (up to 2 wt %), nitrogen (up to 0.2 wt %), columbium (up to 3.5 wt %), tantalum (up to 1 wt %), yttrium (up to 1 wt %), scandium (up to 1 wt %), hafnium (up to 1 wt %), and balance iron. The manufacturing and fabrication processing techniques are described as follows:

1. Melting

A. A ferromanganese melt is prepared in an arc furnace usually with scrap steel additions and at least one of the elements from the group consisting of chromium, copper, molybdenum, silicon, nickel, columbium, vanadium, titanium, boron, nitrogen, cobalt, zirconium, tungsten, tantalum, yttrium, scandium, and hafnium are introduced into the melt as needed with X-ray examination by standard samples to determine suitable compositional adjustment.

B. When the steel in the arc furnace is fully melted, the liquid steel is evenly poured into the ladle furnace where a suitable amount of aluminum is present either in solid or liquid form. The mixing of liquid steel and aluminum will melt the aluminum if it is solid and will give off a lot of heat which will keep the temperature of the ladle furnace from 1480° C. to 1600° C.

C. The liquid steel in the ladle furnace is further mixed with the top/bottom/side blowing of nitrogen, argon or argon and nitrogen mixed gas to obtain a homogenized chemical composition. The nitrogen will be dissolved into the liquid steel during mixing. The gas blowing time will be from 10 seconds to 10 minutes. Meanwhile, the argon can be mixed with nitrogen to improve the stirring if necessary to permit escape of gases. After the blowing, holding time from one to twenty minutes will permit escape of gases. In order to have a good quality of the cast, the tapping temperature of the liquid steel will be controlled between 1350° C. and 1550° C.

2. Surface treatment and passivation

The Fe-Mn-Al-C based hot-worked, hot-rolled or cold-rolled plates, sheets, strips, coils or products are designed to pass the continuous annealing line or batch-type annealing furnace with argon, reducing oxidizing or regular atmosphere protection. The annealed or as hot-worked (hot-rolled) plates, sheets, strips, coils or products may be descaled conventionally. The desired surface treatment of the invention is accomplished by means such as acid pickling, electrogrinding, electropolishing, anodizing, high-energy surface heating, etc. Surface treatments provide the formation of the passive protection film. By using the high-energy surface heating on the surface, the decreasing of manganese content on the surface layer or the increasing amounts of aluminum and/or chromium will lead the alloys to have more effective corrosion resistance surface.

The products of the said Fe-Mn-Al-C based alloys include ingot, slab, billet, bloom, castings, bar, rod, wire, plate, hot-rolled strip, hot-rolled sheet, hot-rolled coil, cold-rolled sheet, cold-rolled strip, cold-rolled coil, structure sections, round, wire product, welding wire(rod), rails, tube, pipe, cold drawing wire, tubular products, seamless tubes and seamless pipes. These products are produced with at least one of these processes described above.

The following examples are offered to aid in understanding of the present invention and are not to be construed as limiting the scope thereof. Unless otherwise indicated, all composition percentages are by weight.

EXAMPLE 1

Figure 2:
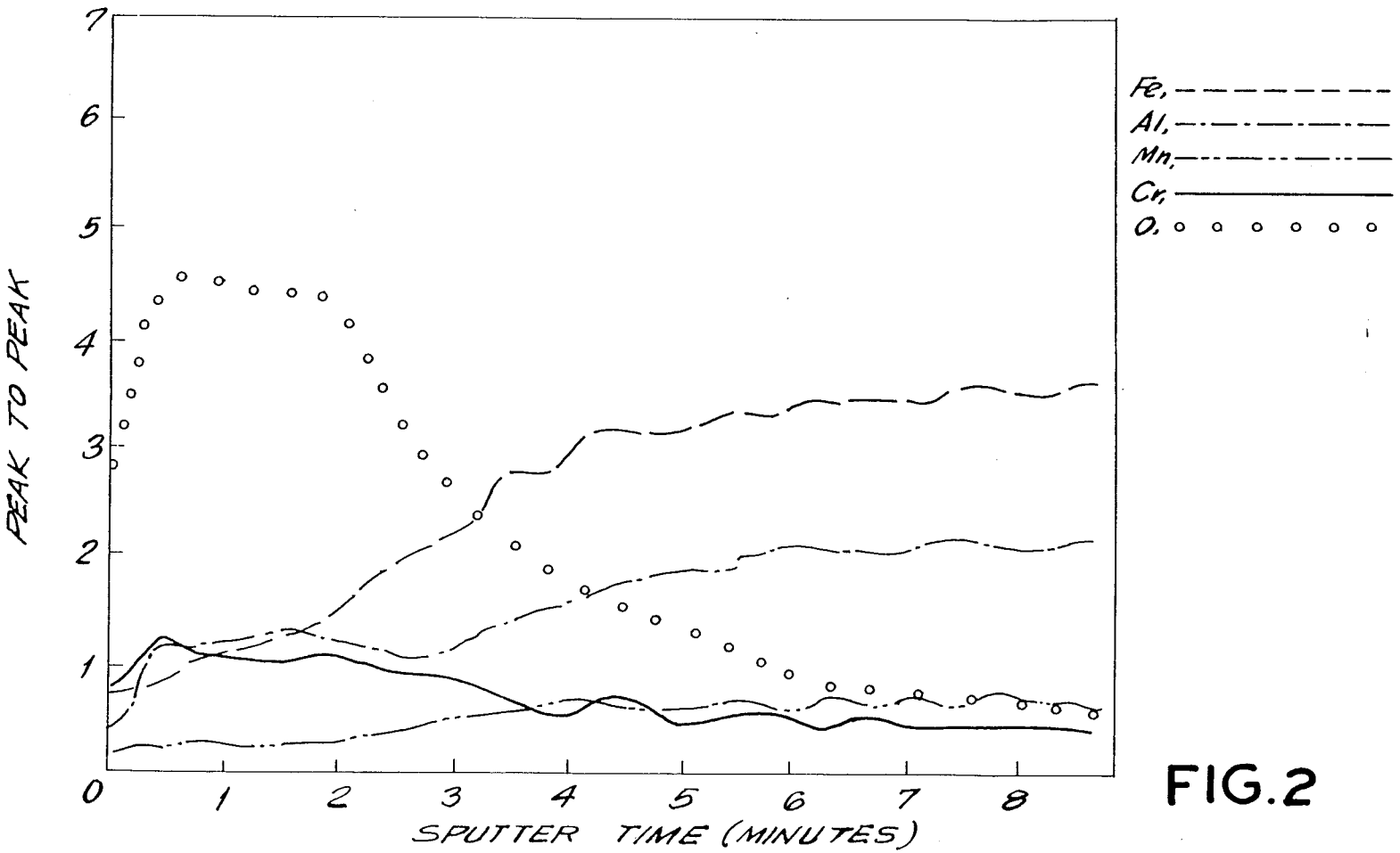
FIG. 2 depicts the surface concentration gradients after pickling treatment.

This example illustrates the surface concentration redistribution of the novel Fe-Mn-Al-C based alloy after pickling and passivation treatments. After these treatments the corrosion resistance increases drastically. The chemical composition of this alloy is 25.4Mn-5.6Al-2.8Cr-0.92C and balance iron. This alloy as cast round bar was cut and homogenized at 1100° C., hot forges at 1200° C. and annealed. After the descaling processes, the alloy was cold rolled to 2.0 mm thick strip. The testing samples were simply surface polished to #600 SiC paper grade after full annealing and then pickling in a solution having 10% nitric acid, 0.2% hydrofluoric acid and water. This sample was immersed in the solution for 3 minutes at 25° C. Concentration of surface elemental redistribution is checked by the Auger Electron Spectrometer (AES). The figures of the surface concentration gradients before and after the treatment are shown in FIG. 1 and FIG. 2, respectively. An important phenomenon is observed for the pickled sample. From the surface concentration gradient curve of FIG. 2, the concentration of aluminum and chromium rose, and manganese content dropped near the surface leading to improved corrosion resistance. With certain arrangements of acid pickling methods, the corrosion resistance would be further improved. It is seen that the surface concentration of chromium and oxygen are increased greatly after the pickling. It is believed that the iron and manganese are removed and chromium-containing oxide films are formed. That is the main protective oxide layer which improves the corrosion resistance of this alloy to a comparable degree to that of stainless steel 304 and 430.

EXAMPLE 2

| An alloy (#623) of the following composition: | |
|---|---|
| Manganese | 25.3% |
| Aluminum | 7.3% |
| Carbon | 0.96% |
| Chromium | 5.6% |
| Molybdenum | 1.2% |
| Iron | balance |

The cast round bar was cut, homogenized, hot forged and annealed. After descaling by sand blasting and acid pickling, the alloy was cold rolled into 2.0 mm thickness. The mechanical properties of the alloy after the cold roll and annealing are shown as following:

| | |
|---|---|
| Yield Strength (ksi) | 65 |
| Ultimate tensile strength (ksi) | 146 |
| % Elongation | 67 |
| Hardness (Rb) | 92 |

EXAMPLE 3

The corrosion experiment samples (#623) prepared for the alloy in example 2 are surface treated with mechanical polishing by using SiC paper up to #600. Some of these samples were further surface pickled and passivated in acid solutions with various inhibitors and rinse process. All of these samples are examined by the potentiodynamic polarization test in 0.1 wt % NaCl aqueous solution to check the corrosion resistance. The traditional stainless steel 430 and 410 were also examined as references. The experimental conditions and corrosion data are listed in Table I. As the higher value of the break-down potential and passivation, the better the corrosion resistance would be. It is found that the corrosion resistance of the properly surface treated sample is much better than that of the untreated sample and is also better than traditional stainless steel 430 and 410.

TABLE I

| alloy | pickling condition* | E break-down(mv) | E passive range(mv) |
|---|---|---|---|
| #623 | none | 130 | 775 |
| #623 | acid only@ | 223 | 823 |
| #623 | acid + $Na_2CrO_4$ | 205 | 655 |
| #623 | acid + $Na_2SiO_3$(0.01M) | 263 | 863 |
| #623 | acid + $Na_2SiO_3$(0.1M) | 252 | 702 |
| #623 | acid + $NaNO_3$ | 220 | 870 |
| #623 | acid + $Na_2SiO_3$(0.005M) | 309 | 925 |
| #623 | acid + $NiSiO_4$ | 261 | 1001 |
| 410 | acid only | 165 | 631 |
| 430 | acid only | 265 | 775 |

*pickling condition: 40 ° C. for 5 minutes.
@acid: 10% $HNO_3$ + 0.2% HF

EXAMPLE 4

Three alloys (#105, #106, #107) with the chemical compositions listed in Table II were prepared by induction furnace in atmosphere. After the homogenization and surface grinding, the alloys were hot rolled into plate shape. The alloys were annealed at 1100° C. The plates were sand blasted, descaled and cold rolled to 2 mm thick strip, followed by annealing again. The mechanical properties of these three alloys are listed in Table III. They are quite similar to those of the 200 series traditional stainless steel.

TABLE II

| sample no. | Mn | Al | C | Cr | others |
|---|---|---|---|---|---|
| #105 | 24.2 | 7.5 | 0.96 | 3.2 | 0.005N |
| #106 | 30.4 | 6.9 | 0.84 | 5.6 | — |
| #107 | 27.3 | 8.0 | 0.98 | 0 | — |

alloy elements - % by weight.

TABLE III

| sample no. | yield strength (ksi) | ultimate tensile strength (ksi) | % elongation | hardness (Rb) |
|---|---|---|---|---|
| #105 | 64.5 | 145.8 | 52 | 91.5 |
| #106 | 62 | 142 | 53 | 89.8 |
| #107 | 65 | 146.5 | 53 | 92 |

EXAMPLE 5

The corrosion experiments for the alloys (#105, #106, #107) in example 4 were surface treated by mechanical polishing by SiC paper up to #600. Certain of these samples were further pickled in different acid solution and then rinsed in weak basic water. Immersing test for all three alloys are carried in the 3.5 wt % NaCl aqueous solution to determine the corrosion resistance. The resulting data are shown in Table IV.

TABLE IV

| pickling solution corrosion rate* sample | 5% $HNO_3$ + 0.2% HF | 10% $HNO_3$ + 0.2% HF | 7% $H_3PO_4$ + 25 g/l $H_2CrO_4$ | without pickling |
|---|---|---|---|---|
| #105 | 0.018 | 0.020 | 0.70 | 0.098 |
| #106 | 0.010 | 0.015 | 0.050 | 0.074 |
| #107 | 0.150 | 0.140 | 0.120 | 0.160 |

*corrosion rate in mm/yr unit.

EXAMPLE 6

This example illustrate that the corrosion resistance of the Fe-Mn-Al-C based alloy enhanced greatly the surface electropolishing process. The alloys used in this example are the same as those used in example 4 and 5, and all the preparation processes were the same. The samples for the electropolishing process were held at 20° C. for 5 minutes and the current density was kept at 1.4 amp/$cm^2$ in two different solutions. These electropolished samples were rinsed in weak basic water and clean water. After the immersion experiment in the 3.5 wt % NaCl aqueous solution for one month, the corrosion data are shown in Table V, improvement that came from the surface treatment for these Fe-Mn-Al-C based alloys is found.

TABLE V

| electropolishing solution corrosion rate* sample | 80% $HClO_4$ + 20% $CH_3COOH$ | 10% $CrO_3$ + 70% $H_3PO_4$ + 20% $H_2SO_4$ | without electro-polishing |
|---|---|---|---|
| #105 | 0.022 | 0.068 | 0.098 |
| #106 | 0.015 | 0.014 | 0.074 |
| #107 | 0.130 | 0.119 | 0.160 |

*corrosion rate in mm/yr unit

EXAMPLE 7

Three alloys #501, #911, #912 with the chemical compositions listed in Table VI were prepared with similar processes that are indicated in example 4. The mechanical properties were measured after the annealing process and were listed in Table VII. The mechanical properties of the traditional stainless steels 200 series were also listed. It is obvious that the workability and formability of the Fe-Mn-Al-C based alloys are quite similar to the traditional 200 series stainless steel.

TABLE VI

| alloy | Mn | Al | C | Cr | Mo |
|---|---|---|---|---|---|
| #501 | 29.7 | 7.8 | 0.99 | 0 | 0 |
| #911 | 24.9 | 5.9 | 0.9 | 5.3 | 0 |
| #912 | 25.4 | 5.7 | 0.99 | 5.2 | 1.1 |

TABLE VII

| alloy | yield strength (ksi) | ultimate tensile strength (ksi) | % elongation | hardness (Rb) |
|---|---|---|---|---|
| #501 | 61 | 128 | 60 | 90 |
| #911 | 60 | 126 | 62 | 88 |
| #912 | 62.5 | 130 | 65 | 91 |
| S.S.201 | 55 | 115 | 55 | 90 |
| S.S.201 | 55 | 105 | 55 | 90 |

Figure 3:
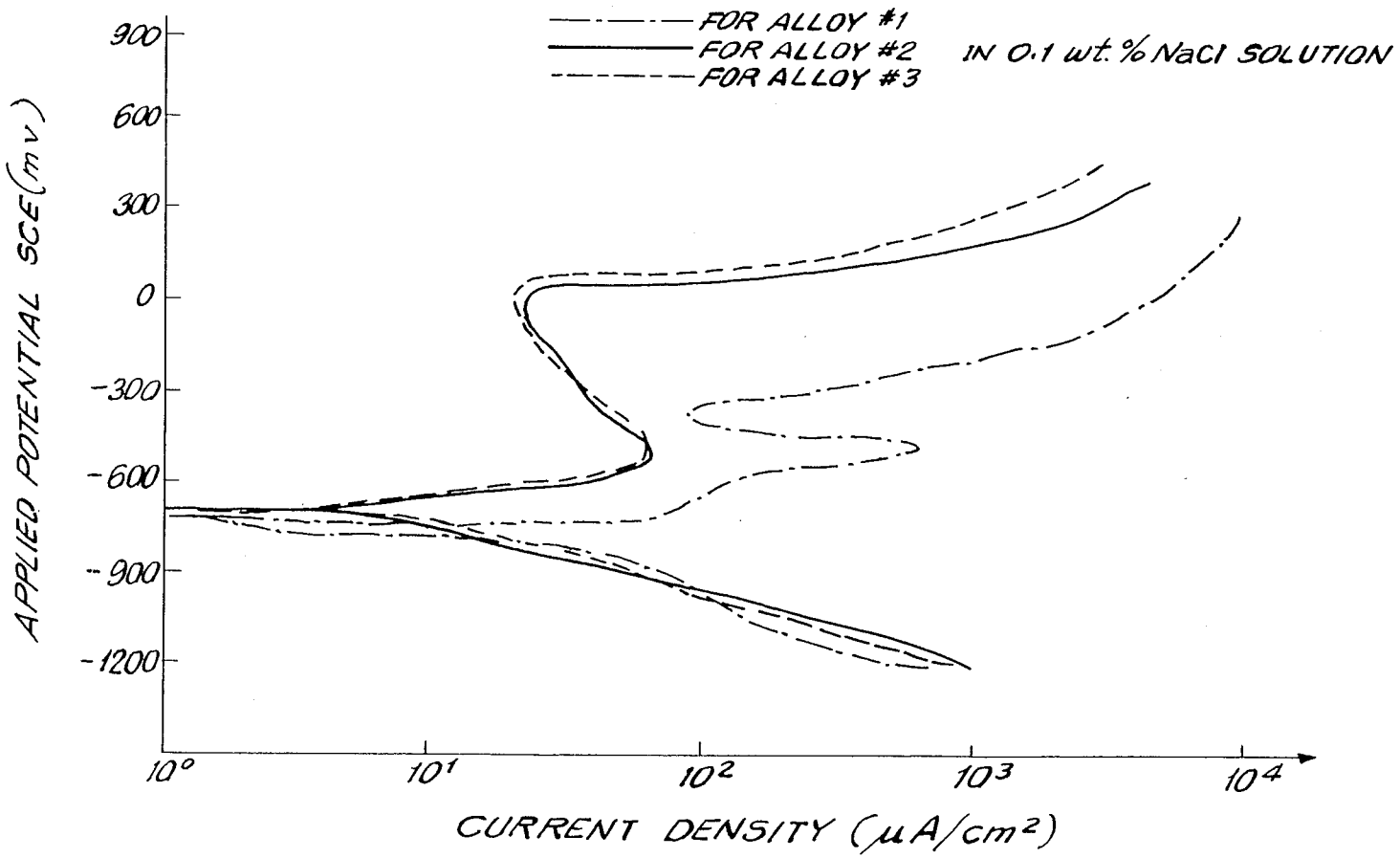
FIG. 3 depicts the potentiodynamic polarization curves of the alloys tested in 0.1 wt % NaCl solution.

EXAMPLE 8 electrochemical corrosion tests for the three alloys in example 7 are carried by using potentiodynamic polarization curves in 0.1 wt % NaCl aqueous solution, as shown in FIG. 3. The breakdown potential and the passivation range of these samples are listed in Table VIII. With the adding of chromium to the Fe-Mn-Al-C based alloys (#501), the corrosion resistance is greatly improved by the forming of chromium oxides in the surface (for alloy #911). For the further adding of molybdenum to alloy #911, the molybdenum contained alloy #912 exhibits an even better corrosion resistance. It is believed that molybdenum inhibits the formation of MnS particles and enhances corrosion resistance.

TABLE VIII

| sample no. | break-down potential (mv) | passive range (mv) |
|---|---|---|
| #501 | −380 | 340 |
| #911 | +40 | 740 |
| #912 | +90 | 790 |

EXAMPLE 9

Test sample for the alloy (#625) with the chemical compositions as following:

| | |
|---|---|
| Manganese: | 26.8% |
| Aluminum: | 7.2% |
| Carbon: | 0.97% |
| Chromium: | 5.3% |

was prepared with the similar processes as described in the previous example 1.

The density of the alloy is measured by using Archimedes principle. The densities of the Fe-Mn-Al-C based alloy is this example and the traditional stainless steel 304, 430, 201 are listed in Table IX. The novel alloy is about 14% lighter than the traditional stainless steel. The apparantly lower density of the Fe-Mn-Al-C based alloy is a characteristic property in excess of the traditional stainless steel which makes the alloy lighter in weight and more economical in applications.

TABLE IX

| sample no | density (g/cm$^3$) |
|---|---|
| #625 | 6.85 |
| S.S.201 | 7.8 |
| S.S.304 | 8.0 |
| S.S.430 | 7.8 |

EXAMPLE 10

Alloys that are shown in Table X produced in the ways as described in example 2, and then tested for mechanical properties as listed in Table XI. Alloys #724, #141 are cracked during cold rolling.

It shows that as the chromium content reaches to 7.4 wt %, the alloy is always broken during cold rolling, even when the manganese is as high as 29.8 wt %. In addition, when the nickel content reaches to 3.4 wt %, the alloy also becomes very brittle during cold working. The casting and hot working properties are still very good.

These alloys were further surface treated by mechanical polishing to #600 SiC paper and were examined for corrosion resistance by electrochemical corrosion tests. The breakdown potential and passive range are listed in Table XII. The examples shown contain manganese between 19 wt % to 30.5 wt %, the aluminum content between 4.9 wt % to 7.5 wt %, the chromium content between 2.8 wt % to 6.5 wt %, the carbon content between 0.69 wt % to 1 wt %, the molybdenum content up to 2.1 wt %, the copper content up to 3 wt %, the nickel content up to 1 wt %, the silicon content up to 1.5 wt %, up to 0.1 wt % columbium, up to 0.2 wt % titanium with the balance iron, although one or more minor elements such as nitrogen, boron, zirconium, vanadium, tungsten, cobalt under suitable range control may be added.

TABLE X

| Alloy No. | Mn | Al | C | Cr | Others | Note |
|---|---|---|---|---|---|---|
| #139 | 26.1 | 5.5 | 1.0 | 2.9 | — | |
| #220 | 25.3 | 6.4 | 0.69 | 4.9 | 1Ni | |
| #106 | 25.0 | 5.7 | 0.89 | 5.6 | — | |
| #316 | 21.0 | 6.2 | 0.78 | 5.8 | — | |
| #633 | 25.5 | 6.9 | 0.99 | 5.5 | 1Cu, 1.2Mo | |
| #121 | 28.0 | 6.8 | 0.9 | 6.7 | 2.1Mo, 0.2Ti | |
| #727 | 29.8 | 5.9 | 0.83 | 7.4 | — | cracked during cold rolling |
| #141 | 30.3 | 7.5 | 0.85 | 5.6 | 3.4Ni | creaked during cold rolling |
| #201 | 19.6 | 6.4 | 0.97 | 6.4 | 1.6Mo, 2Cu | |
| #822 | 27.1 | 4.9 | 0.95 | 6.5 | 1.75Mo, 0.1Cb | |

TABLE XI

| sample no. | yield strength (ksi) | ultimate tensile strength (ksi) | % elongation | hardness (Rb) |
|---|---|---|---|---|
| #139 | 53.4 | 134.4 | 63 | 87 |
| #220 | 57.2 | 112.8 | 65 | 88 |
| #106 | 58.3 | 135.2 | 62 | 89 |
| #316 | 63.1 | 142.0 | 58 | 92 |
| #633 | 63.8 | 144.3 | 65 | 92 |
| #121 | 63.0 | 140.2 | 59 | 91 |
| #201 | 62.2 | 142.5 | 65 | 91 |
| #822 | 59.0 | 136.6 | 63 | 91 |

TABLE XII

| sample no. | break-down potential (mv) | passive range (mv) |
|---|---|---|
| #139 | +10 | 543 |
| #220 | +115 | 638 |
| #106 | +62 | 587 |
| #316 | +100 | 620 |
| #633 | +180 | 675 |
| #121 | +131 | 761 |
| #201 | +115 | 745 |
| #822 | +180 | 660 |

I claim:

1. Articles and parts made of an alloy consisting essentially of by weight 10% to 45% manganese, 4% to 15% aluminum, 0.01% to 1.4% carbon, up to 2.5% silicon, about 3% to 12% chromium, and the balance essentially iron, having the surface thereof treated chemically or electrochemically to provide surface layer enhanced in chromium to improve the corrosion resistance thereof.

2. Articles and parts made of an alloy consisting essentially of by weight 10% to 45% manganese, 4% to 15% aluminum, 0.01% to 1.4% carbon, 3% to 12% chromium, and the balance essentially iron, having the surface thereof treated by high energy pulse heating to provide a surface layer enhanced in chromium to improve the corrosion resistance thereof.

3. Articles and parts according to claim 2 wherein said alloy also contains at least one of boron up to 2000 ppm, an element from the group consisting of columbium, titanium, cobalt, vanadium, and tungsten in an amount of up to 3.5 wt %, nitrogen up to 0.2 wt %, copper from 0.1 wt % to 4.0 wt %, nickel up to 4.0 wt %, molybdenum up to 4.0 wt % and an element from the group consisting of scandium, tantalum, hafnium and yttrium from 0.01 wt % to 1.0 wt %.

4. Articles and parts according to claim 2 wherein said alloy also contains at least one of boron up to 2000 ppm, an element from the group consisting of columbium, titanium, cobalt, vanadium, and tungsten in an amount of up to 3.5 wt %, nitrogen up to 0.2 wt %, copper from 0.1 wt % to 4.0 wt %, nickel up to 4.0 wt %, molybdenum up to 4.0 wt % and an element from the group consisting of scandium, tantalum, hafnium and yttrium from 0.01 wt % to 1.0 wt %.

5. The melting method for producing a Fe-Mn-Al-C alloy which comprises melting ferromanganese and steel scrap in an arc furnace, adjusting the carbon content of the resulting melt to be not more than about 1.4 wt % by oxygen blowing, transferring the resulting melt to a ladle containing the desired aluminum addition, and while maintaining the metal temperature in the ladle in the range of about 1600° to 1480° C., mixing the melt in said ladle by blowing said melt with a non-oxidizing gas to obtain a homogeneous composition and tapping the resulting melt.

6. Articles and parts made of an alloy consisting essentially of by weight about 19% to about 30% manganese, about 4.9% to about 7.5% aluminum, about 2.8% to 6.5% chromium, about 0.69% to about 1% carbon, up to 2.1% molybdenum, up to 2% copper, up to 0.2% titanium, up to 0.1% columbium, up to about 1% nickel and the balance essentially iron, having the surface thereof treated chemically, electrochemically, or by high energy pulse heating to provide a surface layer depleted in manganese and enhanced in chromium to improve the corrosion resistance thereof.

7. Surface hardened Fe-Mn-Al-C alloys consisting essentially of 10% to about 45% manganese, about 4% to about 15% aluminum, about 0.01% to about 1.4% carbon, 0 to 12% chromium, 0.01% to 2.5% silicon and the balance essentially iron having a nitrided surface layer formed by nitriding at a temperature between about 400° and 1150° C. with a strong bonding between said surface layer and the matrix of said alloy.

8. The process for improving the corrosion resistance of an alloy consisting essentially of by weight about 10% to about 45% manganese, about 4% to about 15% aluminum, about 0.01% to about 1.4% carbon, 0 to 12% chromium, and the balance essentially iron which comprises subjecting the surface of said alloy to chemical or electrochemical pickling to provide a surface layer depleted in manganese as compared to the manganese content of the matrix of said alloy.

9. The process of claim 8 wherein said alloy contains 3% to about 12% chromium and said pickling provides a surface layer depleted in manganese and enhanced in chromium as compared to the alloy matrix contents of these elements.

10. The process for improving the corrosion resistance of an alloy consisting essentially of by weight about 10% to about 45% manganese, about 4% to about 15% aluminum, about 0.01% to about 1.4% carbon, about 0 to 12% chromium and the balance essentially iron which comprises subjecting the surface of said alloy to high energy pulse heating to provide a surface layer depleted in manganese as compared to the alloy matrix of said alloy.

11. The process of claim 10 wherein said alloy contains by weight about 3% to about 12% chromium and said high energy pulse heating provides a surface layer depleted in manganese and enhanced in chromium as compared to the alloy matrix contents of these elements.

12. The process of claim 8 wherein said alloy also contains at least one of boron up to 2000 ppm, an element from the group consisting of columbium, titanium, cobalt, vanadium, and tungsten in an amount of 0.1 wt % to 3.5 wt %, nitrogen up to 0.2 wt %, molybdenum up to 4.0 wt %, copper from 0.1 wt % to 4.9 wt % nickel from 0.1 wt % to 7.5 wt %, and an element from the group consisting of scandium, tantalum, hafnium and yttrium from 0.01 wt % to 1 wt %.

13. The process of claim 12 wherein said alloy also contains at least one of boron up to 2000 ppm, an element from the group consisting of columbium, titanium, cobalt, vanadium, and tungsten in an amount of 0.1 wt % to 3.5 wt %, nitrogen up to 0.2 wt %, molybdenum up to 4.0 wt %, copper from 0.1 wt % to 4.0 wt % nickel from 0.1 wt % to 7.5 wt %, and an element from the group consisting of scandium, tantalum, yttrium and hafnium from 0.01% to 1%.

* * * * *